United States Patent [19]

Eriksson et al.

[11] Patent Number: 4,774,509

[45] Date of Patent: Sep. 27, 1988

[54] RESET DEVICE FOR INDICATOR

[75] Inventors: Rolf Eriksson; Gudmar Hammarlund, both of Västeras; Lars-Erik Sundqvist, Örebro, all of Sweden

[73] Assignee: ASEA Aktiebolag, Västeras, Sweden

[21] Appl. No.: 895,939

[22] Filed: Aug. 13, 1986

[30] Foreign Application Priority Data

Aug. 15, 1985 [SE] Sweden ..... 8503820

[51] Int. Cl.[4] ..... G09F 9/30

[52] U.S. Cl. ..... 340/783; 340/815.08; 340/815.24; 340/815.27

[58] Field of Search ..... 340/783, 815.05, 815.08, 340/815.23, 815.27, 788, 815.24, 815.29; 335/205-207

[56] References Cited

U.S. PATENT DOCUMENTS

| | | | |
|---|---|---|---|
| 3,025,512 | 3/1962 | Bloechl | 340/815.24 |
| 3,140,431 | 7/1964 | Schalkwijk | 340/815.24 X |
| 3,140,553 | 7/1964 | Taylor | 340/815.24 X |
| 3,267,455 | 8/1966 | McGuire et al. | 340/815.27 X |
| 3,267,595 | 8/1966 | Levy et al. | 340/815.24 X |
| 3,303,494 | 2/1967 | Taylor et al. | 340/815.27 |
| 3,591,939 | 7/1971 | Payne et al. | 340/788 X |
| 3,624,647 | 11/1971 | Smith | 340/815.27 |
| 3,636,556 | 1/1972 | Pihl | 340/815.24 |
| 3,648,269 | 3/1972 | Rosenweig et al. | 340/788 X |
| 3,704,462 | 11/1972 | Pihl | 340/815.26 |
| 3,813,673 | 5/1974 | Holloman | 340/815.27 |
| 3,820,047 | 6/1974 | Juhnke | 340/815.23 X |
| 4,115,941 | 9/1978 | Stephenson | 340/783 |
| 4,328,492 | 5/1982 | Bobak et al. | 340/764 |
| 4,394,652 | 7/1983 | Rabette | 340/815.23 X |
| 4,417,241 | 11/1983 | Wakatake | 340/815.05 |
| 4,566,003 | 1/1986 | Wakatake | 340/783 X |
| 4,616,221 | 10/1986 | Tanaka et al. | 340/783 |
| 4,675,476 | 6/1987 | Kobayashi | 340/788 X |

OTHER PUBLICATIONS

R. Graf, *Dictionary of Electronics,* p. 437, (1974; Sams & Co., Indianapolis).

*Primary Examiner*—Theodore M. Blum
*Assistant Examiner*—Bernarr Earl Gregory
*Attorney, Agent, or Firm*—Watson, Cole, Grindle & Watson

[57] ABSTRACT

A device for mechanically resetting, by means of a simple manipulation, an optional number of status indicators of the type consisting of an electromagnet with an iron core, a magnetizing winding and some form of permanently magnetized indicating disk capable of rotating through 180°. The device comprises a rail made of a non-magnetic material and being formed so as to enable a desired number of indicators to be mounted side-by-side. The rail has such a profile as to enable a shuttle with a corresponding profile to be in engagement with and be guided by and slide on the rail in its longitudinal direction. The shuttle is provided with a permanent magnet as well as with a pole piece mounted so as to form, together with the core in the electromagnet of each indicator, a magnetic circuit when the shuttle is pushed over the respective indicator whereby the rotatable indicating disk is influenced and is reset to indicate the reset position.

8 Claims, 1 Drawing Sheet

RESET DEVICE FOR INDICATOR

TECHNICAL FIELD

Status indicators are used in many different applications to indicate, for example, a condition existing in an industrial process, whether a circuit-breaker or contactor is switched on or not, whether a fault has occured in an electrical power system, etc.

Status indicators are also often used in telecommunications, in connection with overloads of various kinds, in automatic train control arrangements, etc.

In many technical fields there is a need that, when a change of a condition has taken place and the status indicator has indicated this change, the changed indication of the indicator be retained after the condition being monitored has resumed its original state. Thus, there is a need for status indicators with a memory facility. Of special interest in this connection are the so-called bistable indicators which can be activated or reset with the aid of a brief pulse, which may be a pulse of electrical current (through a magnetizing winding) or a magnetic pulse. Bistable indicators display the indicating state which was caused by the last applied pulse and retain that display until reset. When the reason for the change of state has been investigated and possible faults have been corrected, the indicator can be reset.

The invention relates to a device enabling the mechanical re-setting of any required number of status indicators by means of a simple manual operation.

BACKGROUND ART, PROBLEMS

The requirement that a status indicator should have a reliable long-term memory in principle excludes the use of lamps and light-emitting diodes for this purpose. The need for a memory function suggests that the indicator be substantially formed as a relay with a flag or as an electromagnet with an iron core and a magnetizing winding and with some form of permanently-magnetized indicating disk which is movable magnetically between its bistable rest states (e.g. rotatable through 180°). This invention relates to a status indicator according to the latter alternative, that is, where indication is performed with a rotatable disk which, when one of its surfaces faces in the viewing direction, indicates a normal state and which, after an activation pulse, turns its other surface to the viewing direction. to be able to distinguish the two states from each other in a simple manner, widely contrasting colours can be used on the two surfaces.

When the electromagnet is not magnetized by the passage of current through the energising winding, there will still be some residual magnetism in the electromagnet due to the remanence. The north-magnetic pole of the permanent magnet located on the rotating disk will then be attracted towards the south-magnetic pole (determined by the remanence), of the electromagnet and vice versa.

From a non-indicating or normal state, the indicator is activated and indicates a change of state in the monitored object when the electromagnet is magnetized with the aid of a current pulse in the energising winding. The winding and current directions are then assumed to be such that the magnetic poles of the electromagnet change polarity in relation to the existing remanence. The disk is thereby rotated through 180° and presents to the viewing direction that surface which indicates that a change of state has taken place. Owing to the remanence existing in the electromagnet, even after the indicating current pulse has died away, the disk will remain in the indicating position, so that a reliable memory function is obtained.

There are a number of manufacturers of status indicators who utilize the principle described above, for example Ferranti-Packard (Canada) and Sasse (Fed. Rep. of Germany).

Resetting of the indicator to a non-activated condition is performed either by conducting a current pulse of opposite polarity through the energising winding, whereby the polarity of the magnetic poles of the electromagnet is changed, or by conducting a current pulse through a special reset winding.

However, the above resetting method presupposes that a source of current be available, which is not the case in several applications, for example where a d.c. battery is missing. If, for example, the indication is of a fault on the power supply system, the part subjected to the fault is normally disconnected. In such cases it may be desirable to reset the indicator before any fault-removing measures are taken for example to see whether the fault has disappeared after a reclosing, to be able to see any consequential faults, and so on.

The problem of resetting the indicator when no current is available for resetting has existed for a long time. For individual indicators this has been solved in such a way that a relatively strong permanent magnet has been built into a casing comprising the indicators and a manual operating member for the permanent magnet. By moving the permanent magnet—the poles of which are oriented with opposite polarity in relation to the remanent magnetic polarity existing in the electromagnet after the latter has been activated by a current pulse—past the electromagnet, the latter is re-magnetized in the direction to again move the indicating disk through 180° and return the indicator to its non-activated state.

However, manual permanent-magnetic reset devices available on the market have certain limitations and cause problems in several respects:

They exist in a form which is integrated with the status indicator, i.e., each device has its own remagnetization unit.

Existing status indicators with a manual magnetic reset facility cannot be mounted adjacent each other in any orientation since the permanent magnet for resetting which is included has such high magnetic energy that its field may disadvantageously affect an adjacently positioned status indicator.

These integrated design solutions are considerably more space-demanding than the status indicator alone.

These facts taken together mean that the necessary space for a number of status indicators with magnetic reset facility will be considerably greater than for the same number of indicators without a reset facility.

The requirement for compact integrated system solutions where status indicators with manual magnetic resetting are included is thus impossible to fulfil.

From the point of view of cost, the price of a status indicator with a manual magnetic reset facility will be multiplied in relation to the cost of an indicator with an indicating function only.

At present there are no design solutions on the market which enable rapid resetting of an optional but large number of indicators by means of a simple manual operation.

There is thus a great need for a status indicator which is superior to existing designs both from a functional, space-saving and cost point of view.

DISCLOSURE OF THE INVENTION, ADVANTAGES

The invention comprises a device in the form of a rail manufactured from some non-magnetized and optionally transparent material having a specially-shaped profile for the intended function. The rail has such a profile and such a length as to allow the desired number of status indicators to be mounted side-by-side in the longitudinal direction of the rail. In addition, the rail is formed so as to enable a shuttle to be guided by and slide on the rail in the longitudinal direction thereof.

The shuttle is provided with a permanent magnet as well as with a pole piece of soft-magnetic material. The magnetic parts in the shuttle are mounted so that they form, together with the core in the electromagnet of the status indicator, a magnetic circuit having as small an airgap as possible between the core legs of the electromagnet and the surrounding pole pieces in the shuttle. Normally, the shuttle is stationed at one end of the rail where the rail can be provided with an end wall having a soft iron part formed so as to provide a keeper for the magnet in a "parking position" of the shuttle. The flux of the permanent magnet will then be directed such that the distance needed to prevent unintentional influence on the indicating devices is minimized. This also results in the shuttle being retained in the parking position owing to the attractive forces between the magnet and its keeper, so that shocks and vibrations are unlikely to cause the shuttle to move from its parking position and inadvertently reset the indicators.

By allowing the shuttle to slide on the rail, thus passing over all the indicators mounted in the rail, the indicators can be reset one after the other and possibily remain in a reset position. This is accomplished by mounting the permanent magnet of the shuttle with such a pole orientation that the remanence which remains in the core of each electromagnet, after the shuttle has passed over the indicator, has such a direction that the indicating disk is turned so that the indicator shows its unactivated condition.

Activation of the indicators is achieved, as mentioned above, by allowing a current pulse to pass through the energising winding of the electromagnet. It is then presupposed that the winding and current directions are such they jointly provide a remagnetization of the pole core of the electromagnet in relation to the remanence which remains after resetting, the indicating disk thus turning round and showing its activated condition.

The advantages of a design as above for the resetting of a plurality of indicators are several and obvious:

All the indicators included in an assembly of any required number can be reset by a simple manipulation.

It permits a compact design.

The rail can be manufactured and cut to desired lengths according to the number of status indicators that may require to be mounted.

The end walls of the rail are independent of the length of the rail or the number of status indicators present.

DESCRIPTION OF THE PREFERRED EMBODIMENTS

Figure 1:
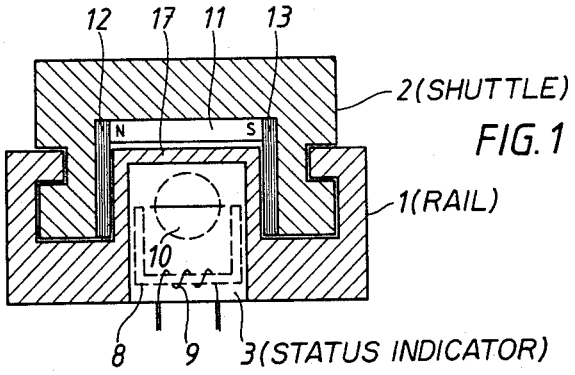
FIG. 1 shows a section through a rail, a shuttle and one status indicator in accordance with the invention, and, FIG. 2 shows a schematic plan view of a rail with a number of indicators, a shuttle and walls seen from above/from the front.
Figure 2:
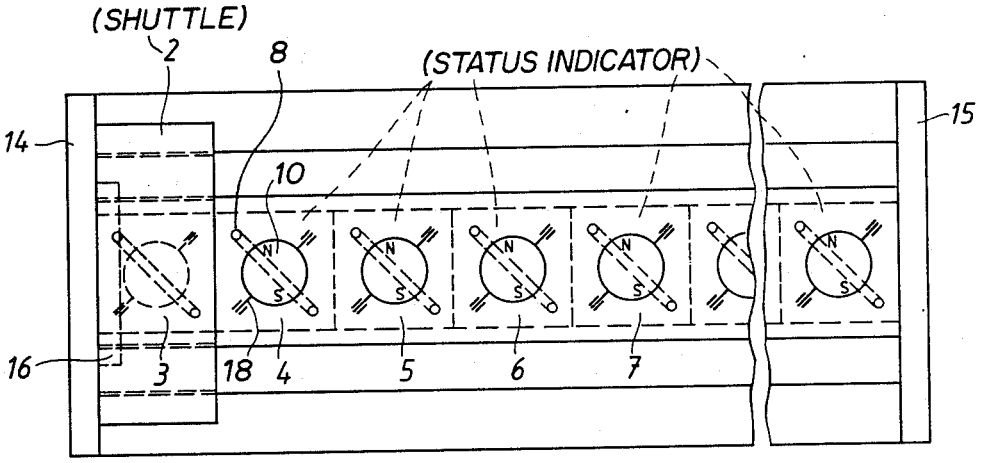

A device according to the invention can be constructed as shown in FIGS. 1 and 2. The device comprises a rail 1 made from some transparent and non-magnetic material and provided with a profile such that a shuttle 2 can be pushed by a simple manual operation, over indicators 3, 4, 5, 6, 7 mounted in the rail 1. The shuttle 2 remains permanently in engagement with the rail.

Each indicator comprises an electromagnet with a core 8 and a winding 9 and has an indicating disk 10 which is provided with a permanent magnet and is rotatable through 180° about an axis 18. As is clear from FIG. 2, the core 8 in the electromagnet of each indicator is inclined at an angle of 45° with respect to the longitudinal axis of the rail 1, and each indicating disk 10 is journalled at an angle of 90° relative to the core 8 of the electromagnet.

The shuttle 2 is provided with a permanent magnet 11 and with pole pieces 12 and 13 of a soft-iron magnetic material.

Further, the rail 1 is provided with two end walls 14 and 15, of which the end wall 14 incorporates a soft-iron keeper 16, whereby the region of the rail 1 adjacent to the end wall 14 will function as a parking position for the shuttle 2. Also, as mentioned above, the risk of any field from the permanent magnet 11 influencing the indicators is minimized.

Because of the attractive force which exists between the permanent magnet 11 of the shuttle 2 and the soft-iron keeper 16 of the end wall 14, the shuttle 2 will be positively retained in its parking position even in the face of relatively severe shocks and vibrations.

The profile of the rail 1 and of those parts of the shuttle 2 making contact with the rail 1 may, of course, be formed in many different ways. It is important that the shuttle 2 be in continuous engagement with the rail 1 in such a way that it can easily be manually pushed along the rail 1 and is guided by the rail so as to prevent jamming of the shuttle 2 on the rail 1. Considerable demands will therefore be placed on the design and tolerances used during manufacture in order to ensure perfect operation.

Depending on the application in question, the number of indicators required may vary widely. Adaptation of the length of the rail 1 can however be performed in a simple manner by cutting a standard length of rail 1 into the desired length.

Strictly speaking, the requirement for the rail 1 to be transparent refers only to that part of the rail 1 which lies above the rotatable disks of the indicators. In the example that is illustrated the part of the rail 1 which lies between the permanent magnet 11 of the shuttle 2 and the indicators built into the rail 1 (i.e., the central region 17 of the rail shown in FIG. 1). Several alternative rail designs are possible to make the indicating disks 10 visible. One alternative is to make the rail 1 of a non-transparent material but to remove a sufficient part of the central region 17 of the rail 1 that the indicating disks 10 become available for inspection. The openings left between the indicators and the shuttle 2 can be covered with a transparent window which is glued or otherwise fixed to the rail 1. Another alternative design solution is to make the rail 1 from three parts, of which two are side parts constituting a guide profile and one is a transparent central part 17. The side parts, which are all held together by the end walls 14 and 15, can then be manufactured of a non-transparent material. The joining together of the three parts can be performed by glueing or in any other manner which provides a suitable product.

We claim:

1. An indicator mechanism which comprises:

an elongated rail which, when horizontally oriented, defines an upper surface, a lower surface, and a longitudinal axis line;

at least one status indicator device mounted within said elongated rail, said at least one status indicator device including: (1) an electromagnet that includes a core having legs that extend toward the upper surface of said elongated rail, (2) a magnetizing winding wrapped around said core, and (3) an indicator disk which includes a permanent magnet and is rotatable by 180°; and a shuttle element which is engaged with said elongated rail and is movable therealong over said upper surface of said elongated rail, said shuttle element including a permanent magnet which has pole pieces that extend towards the lower surface of said elongated rail so as to overlap a portion of the legs of the core of the electromagnet of said at least one status indicator device, movement of said shuttle element along said elongated rail causing the indicator disk of said status indicator device to be rotated into a reset position.

2. An indicator mechanism according to claim 1, wherein a plurality of said status indicator devices are mounted in said rail in a side-by-side fashion along the length of said elongated rail.

3. An indicator mechanism according to claim 2, wherein both said elongated rail and said shuttle element are made of a non-magnetic material.

4. An indicator mechanism according to claim 2, wherein said status indicator devices extend from the lower surface of said elongated rail towards the upper surface thereof, and wherein the portion of said elongated rail between said status indicator devices and the upper surface thereof is made of a transparent material.

5. An indicator mechanism according to claim 2, wherein said elongated rail includes end walls at its opposite ends, said shuttle element being movable along said elongated rail between said end walls.

6. An indicator mechanism according to claim 5, wherein one of said end walls has a soft magnetic portion such that, when said shuttle element is positioned adjacent thereto, a substantially closed magnetic circuit is formed by the soft magnetic portion of said end wall and the core of said permanent magnet in said shuttle element.

7. An indicator mechanism according to claim 2, wherein the core and legs of each electromagnet in each status indicator device is angled at about 45° to said longitudinal axis line of said elongated rail.

8. An indicator mechanism according to claim 7, wherein each indicator disk of each status indicator device is rotatable about an axis which is angled at 90° relative to the associated electromagnet therein.

* * * * *